US007704940B2

(12) United States Patent
Boerefijn et al.

(10) Patent No.: US 7,704,940 B2
(45) Date of Patent: Apr. 27, 2010

(54) GRANULATE FOR USE IN A CLEANING PRODUCT AND PROCESS FOR ITS MANUFACTURE

(75) Inventors: Renee Boerefijn, Vlaardingen (NL); Reinhard Kohlus, Heilbronn (DE); Vidyadhar Sudhir Ranade, Rotterdam (NL)

(73) Assignee: The Sun Products Corporation, Wilton, CT (US)

( * ) Notice: Subject to any disclaimer, the term of this patent is extended or adjusted under 35 U.S.C. 154(b) by 0 days.

(21) Appl. No.: 11/547,825

(22) PCT Filed: Mar. 7, 2005

(86) PCT No.: PCT/EP2005/002467

§ 371 (c)(1), (2), (4) Date: Sep. 20, 2007

(87) PCT Pub. No.: WO2005/097962

PCT Pub. Date: Oct. 20, 2005

(65) Prior Publication Data

US 2008/0119379 A1 May 22, 2008

(30) Foreign Application Priority Data

Apr. 9, 2004 (EP) ..... 04076130
Jun. 24, 2004 (EP) ..... 04076845

(51) Int. Cl.
*C11D 17/06* (2006.01)
*C11D 9/44* (2006.01)
*C11D 3/22* (2006.01)
*C11D 3/50* (2006.01)

(52) U.S. Cl. ..... 510/441; 510/101; 510/298; 510/438; 510/443; 510/444; 510/446; 510/452; 510/470; 510/515

(58) Field of Classification Search ..... 510/101, 510/298, 438, 441, 443, 444, 446, 452, 470, 510/515
See application file for complete search history.

(56) References Cited

U.S. PATENT DOCUMENTS

| | | | | |
|---|---|---|---|---|
| 2,876,160 | A | 3/1959 | Schoch et al. | |
| 3,341,466 | A | 9/1967 | Brynko et al. | |
| 3,577,515 | A | 5/1971 | Vandegaer | |
| 3,971,852 | A | 7/1976 | Brenner et al. | |
| 4,137,180 | A | 1/1979 | Naik et al. | |
| 4,589,989 | A | 5/1986 | Müller et al. | |
| 4,686,063 | A | 8/1987 | Burns | |
| 4,751,015 | A | 6/1988 | Humphreys et al. | |
| 4,814,095 | A | 3/1989 | Puchta et al. | |
| 4,818,426 | A | 4/1989 | Humphreys et al. | |
| 4,908,159 | A | 3/1990 | Davies et al. | |
| 5,061,807 | A | 10/1991 | Gethöffer et al. | |
| 5,066,419 | A | 11/1991 | Walley et al. | |
| 5,154,842 | A | 10/1992 | Walley et al. | |
| 5,259,964 | A | 11/1993 | Chavez et al. | |
| 5,397,501 | A | 3/1995 | Coope | |
| 5,648,328 | A * | 7/1997 | Angell et al. | 510/441 |
| 5,879,920 | A | 3/1999 | Dale et al. | |
| 6,020,066 | A | 2/2000 | Weisser et al. | |
| 6,291,421 | B1 | 9/2001 | Jacques et al. | |
| 6,670,320 | B1 | 12/2003 | Cao et al. | |
| 2002/0123499 | A1 | 9/2002 | Persons et al. | |
| 2002/0187223 | A1 | 12/2002 | McIver et al. | |
| 2003/0125222 | A1 | 7/2003 | Jahns et al. | |
| 2004/0071742 | A1 * | 4/2004 | Popplewell et al. | 424/401 |

FOREIGN PATENT DOCUMENTS

| | | | |
|---|---|---|---|
| DE | 3823172 | A1 | 1/1990 |
| EP | 0 107 479 | A2 | 5/1984 |
| EP | 0 111 074 | A2 | 6/1984 |
| EP | 0 234 082 | A1 | 9/1987 |
| EP | 0 276 999 | A2 | 8/1988 |
| EP | 0 284 292 | A2 | 9/1988 |
| EP | 0 303 520 | A2 | 2/1989 |
| EP | 0 325 288 | A1 | 7/1989 |
| EP | 0 325 289 | A1 | 7/1989 |
| EP | 0 333 270 | | 9/1989 |
| EP | 0 349 940 | A1 | 1/1990 |
| EP | 0 384 070 | A2 | 8/1990 |

(Continued)

OTHER PUBLICATIONS

International Search Report, PCT/EP2005/002467, mailed Jun. 23, 2005, 3 pp.

(Continued)

*Primary Examiner*—Brian P Mruk
(74) *Attorney, Agent, or Firm*—Sterne, Kessler, Goldstein & Fox, P.L.L.C.

(57) ABSTRACT

A granulate for use in a particulate cleaning product, the granulate consisting of granules which comprise: (a) at least 30% by weight of granulation auxiliary selected from water-soluble non-acid organic crystalline solids; and (b) at least 0.1% by weight of functional cleaning material other than an enzyme or an inorganic compound; and (c) optionally, one or more other ingredients. The granulate may instead comprise: (a) at least 20% by weight of granulation auxiliary selected from non-acid water-soluble organic crystalline solids; and (b) at least 0.1% by weight of temperature sensitive functional cleaning material other than an enzyme or an inorganic compound; and (c) optionally, one or more other ingredients.

9 Claims, No Drawings

FOREIGN PATENT DOCUMENTS

| | | | |
|---|---|---|---|
| EP | 0 385 534 | A1 | 9/1990 |
| EP | 0 402 971 | A2 | 12/1990 |
| EP | 0 458 397 | A2 | 11/1991 |
| EP | 0 458 398 | A2 | 11/1991 |
| EP | 0 509 787 | A2 | 10/1992 |
| EP | 0 568 297 | B1 | 11/1993 |
| EP | 0 656 058 | | 6/1995 |
| FR | 2 462 184 | | 2/1981 |
| GB | 0 751 600 | A | 6/1956 |
| GB | 1 429 143 | A | 3/1976 |
| GB | 2 123 044 | A | 1/1984 |
| GB | 2 348 435 | A | 10/2000 |
| JP | 62-57639 | A | 3/1987 |
| JP | 2-182972 | A | 7/1990 |
| JP | 6-306769 | A | 11/1994 |
| WO | WO 92/18593 | A1 | 10/1992 |
| WO | WO 00/03959 | A1 | 1/2000 |
| WO | WO 03/083027 | A1 | 10/2003 |
| WO | WO 03/101606 | A1 | 12/2003 |

OTHER PUBLICATIONS

International Search Report mailed Jun. 23, 2005 for International Application No. PCT/EP2005/002467, 3 pgs, European Patent Office, Rijswijk, Netherlands.

English Abstract for JP 62-05639 A published Mar. 13, 1987, 1 pg (data supplied from the esp@cenet database).

English Abstract for JP 2-182972 A published Jul. 17, 1990, 1 pg (data supplied from the esp@cenet database).

English Abstract for JP 6-306769 A published Nov. 1, 1994, 1 pg (data supplied from the esp@cenet database).

* cited by examiner

GRANULATE FOR USE IN A CLEANING PRODUCT AND PROCESS FOR ITS MANUFACTURE

FIELD OF THE INVENTION

The present invention relates to granulates for use in particulate cleaning products such as laundry wash products, the granulates comprising a temperature sensitive component such as an encapsulated perfume. However, incorporation of other temperature sensitive components is also within the ambit of the present invention. The invention further extends to a method for making such granulates.

BACKGROUND OF THE INVENTION

Several components commonly incorporated in cleaning products are temperature sensitive, such as perfumes, enzymes, bleaches, bleach activators and bleach catalysts.

By way of example, it is common to incorporate perfumes in cleaning products such as laundry wash products to impart a pleasant or fresh smell to the cleaned item. In the case of particulate wash products, it is known to incorporate the perfume in the form of microcapsules containing the perfume.

One method of making such microcapsules is disclosed in U.S. Pat. No. 5,066,419. This reference is concerned with detergent compositions which comprise one or more detersive surfactants, optionally one or more builders and perfume particles of the aforementioned kind. These particles are specifically defined as comprising a core having from about 5% to about 50% by weight of perfume dispersed in from about 95% to about 50% of a "carrier" material of solid fatty alcohol or fatty ester having a molecular weight and melting point. The core is coated with a water-insoluble friable coating. The preferred friable coating is of the urea or melamine plus aldehyde type. The resulting microcapsules have an average particle size less than about 350 microns, preferably not greater than 150 microns.

Formulation of perfumes in microcapsule form has several advantages. First, perfumes are by their nature, volatile. Second, if incorporated in a particulate product, there is the risk of loss of perfume efficacy by evaporation. Another reason is the risk of adverse interactions between the perfume and one or more other components in the product. These problems are overcome or at least mitigated by the microencapsulation technique. It also has the advantage that, depending on the form of microcapsule, in use, the possibility is provided for delayed or extended perfume release, for example in the case of deposition on a fabric in a wash liquor containing a detergent composition for fabrics washing.

Probably the oldest and longest used method of formulating particulate cleaning products is spray drying, whereby granules are formed by spraying a slurry of ingredients against a counterblast of warm air. Around the 1980s, the alternative granulation process of mechanical mixing granulation became popular, typically involving mixing to form granules and then densification of the granules so formed. In both cases, additional ingredients, especially ingredients which are incompatible with other components of the granule, are sometimes post-dosed either in powder or granule form to the base granule formed by spray drying or mechanical granulation.

In recent times, flexible manufacture of ranges of different products has involved making pre-granulated "adjuncts" rich in one or more ingredients such as surfactants or detergency builders or other ingredients such as enzymes or mixtures of such ingredients, then mixing them with other granulates and/or powdered ingredients according to the particular formulation required. In accordance with this manufacturing philosophy, it would be useful to provide adjuncts containing microencapsulated perfume. However, it has been found that use of conventional granulation techniques to provide such granulated adjuncts containing microencapsulated perfume leads to problems.

Specifically, it has been found that to granulate perfume microcapsules by spray drying, as taught US-A-2003/0125222, results in a poor particle size distribution with an undue proportion of fine material in the product. This is undesirable because of the tendency for such a product to segregate. The high temperature involved can also damage the microcapsules, leading to perfume loss.

Sugars have been proposed as water-dispersible binders in granules which contain calcite, non-soap surfactant and other optional ingredients commonly found in laundry cleaning products, as disclosed in U.S. Pat. No. 4,908,159. The highest level of sugar actually disclosed in this reference is 28.6% by weight of sucrose in a granule which additionally contains only calcite and anionic surfactant.

As described in U.S. Pat. No. 5,879,920, enzyme containing granules may be made by forming a core comprising a water soluble material coated with a vinyl polymer, covered with an enzyme layer with polyvinyl pyrrolidone and then another polymer outer layer. The core with its polymer coating contains a water soluble or dispersible material which may be inter alia, a sugar or dispersible starch. The core can constitute up to 85% by weight of the entire granule, up to 95% by weight of that core being the water-soluble or water dispersible material. The enzyme-containing layer may comprise from 5% to 70% by weight of the entire granule, of which the polymer content may represent from 0.1% to 5%.

Lower levels of sugars have also been used in the enzyme containing granules disclosed in EP-A-656 058, in order to improve dispersibility in the wash liquor.

According to US-A-2002/0123449, a highly water-soluble cyclodextrin is granulated with an inorganic compound such as a zeolite or other water soluble or insoluble inorganic detergency builder to form granules which are added to laundry washing powders to reduce malodour from fabrics in the wash. The cyclodextrin can be present up to 90% by weight of the granule.

The inventors have now discovered that the granules containing sensitive ingredients such as perfume microcapsules can be made using a mechanical granulation technique operating at a temperature/energy input low enough not to damage such ingredients by utilising relatively high levels of an organic water-soluble crystalline solid granulation auxiliary. For the avoidance of doubt, the term mechanical granulation technique excludes spray drying but does not preclude a mechanical granulation technique in which one or more of the starting materials are themselves the product of a spray-drying process. The term mechanical granulator is to be construed in like fashion.

Another possible advantage of granules according to the present invention is achieving an appropriate strength of the granules without significant loss of solubility as may occur with inorganic solid granulation auxiliaries.

DEFINITION OF THE INVENTION

A first aspect of the present invention provides a granulate for use in a particulate cleaning product, the granulate consisting of granules which comprise:

(a) at least 30% by weight of granulation auxiliary selected from water-soluble non-acid organic crystalline solids; and (b) at least 0.1% by weight of functional cleaning material other than an enzyme or an inorganic compound; and (c) optionally, one or more other ingredients.

A second aspect of the present invention provides a granulate for use in a particulate cleaning product, the granulate consisting of granules which comprise:

(a) at least 20% by weight of granulation auxiliary selected from non-acid water-soluble organic crystalline solids; and (b) at least 0.1% by weight of temperature sensitive functional cleaning material other than an enzyme or an inorganic compound; and (c) optionally, one or more other ingredients.

A third aspect of the present invention provides a method of making a granulate according to the first or second aspect of the present invention, which method comprises granulating in a mechanical granulator, components (a), (b) and, if present, (c) in a mechanical granulator to form said granules.

DETAILED DESCRIPTION OF THE INVENTION

Particulate cleaning products, as stated above, can comprise granules and/or simple powders. It is common to refer to a particulate laundry wash product as a "washing powder" or "laundry powder". However, for the sake of clarity, the following terminology is used throughout this specification, unless explicitly indicated to the contrary.

The term "granulate" means a granule comprising a plurality of ingredients, for example having a porous complex microcrystalline structure as can be formed by spray-drying or an agglomerate of individual particles (crystalline or amorphous) which can be formed by spray-drying or by mechanical granulation (typically mixing/densification).

Reference to a "powder" is a reference to a simple collection of individual particles of the same or different compositions, in crystalline and/or amorphous form, which particles have not been agglomerated or formed into a granule in any way.

Reference to a "particulate" is used generically and refers to granules, powders, and mixtures thereof.

Granulates according to the present invention may be used in any particulate cleaning product. However, an especially preferred application is in laundry cleaning products and the following detailed description will concentrate upon these.

To avoid any confusion it is noted that the term particulate cleaning product encompasses cleaning products for cleaning and/or conditioning of laundry. Also the term cleaning product and detergent composition are used interchangeably.

The Granulation Auxiliary

The granulation auxiliary consists of one or more water-soluble non-acid organic crystalline solids.

Preferably these are selected from sugars, especially water-soluble crystalline mono-oligosaccharides and the corresponding sugar alcohols, water soluble polysaccharides and water soluble maltodextrins and glucose syrups, especially those having a dextrose equivalent of greater than 2, more preferably greater than 12, dextran and dextran derivatives.

Particularly preferred as granulation auxiliary are one of more of the following saccharides: amylose, isomaltose, isomaltotriose, isomaltotetraose, isomalto oligosaccharide, fructo oligosaccharide, levo oligosaccharide, galacto oligosaccharide, xylo oligosaccharide, gentio oligosaccharide, disaccharides, glucose, dextrose, levose, fructose, galactose, xylose, mannose, sorbose, arabinose, rhamnose, fucose, maltose, sucrose, lactose, maltulose, ribose, lyxose, allose, altrose, gulose, idose, talose, trehalose, nigerose, kojibiose, lactulose, oligosaccharides, malto oligosaccharides, trisaccharides, tetrasaccharides, pentasaccharides, hexasaccharides, oligosaccharides from partial hydrolysates of natural polysaccharide sources and mixtures thereof.

Acidic organic materials such as (poly)carboxylic acids are excluded from the definition of water-soluble crystalline organic solids which may be used as granulation auxiliary, including polymeric materials having one or more pendant carboxylic acid groups. Salts of such materials with inorganic cations are also excluded. However, any such material may be included as "(c) optional other ingredient(s)".

Preferably, in the context of the present invention, a water-soluble organic water-soluble crystalline solid can be considered non-acid if in aqueous solution at 25° C. at 1 atmosphere pressure, it has no dissociable hydrogen ion or else has a maximum pKa of at least 6.5. Reference to "maximum" pKa is necessary because compounds with more than one carboxylic acid group may have a different pKa value for each. Thus, for example, citric acid has respective pKa values which have been reported as about 3.1, about 4.8 and as a highest value, about 5.4 but a value for the last figure as high as 6.4 has also been reported. Nevertheless, citric acid is excluded by the aforementioned definition.

Preferably, in the context of the present invention, any non-acid organic crystalline solid can be considered water soluble if at 25° C., it has a solubility of at least 1 wt %, more preferably at least 2 wt %, still more preferably at least 5 wt % (i.e. 100 g of a saturated aqueous solution would contain 5 g of the dissolved solid and 95 g water).

Preferably, in the context of the present invention, a water-soluble non-acid organic solid can be considered to be crystalline if it can yield a crystal structure when solidified out of aqueous solution.

The amount of granulation auxiliary may be 30% by weight or more of the granulate, in the case of the first aspect of the invention, or 20% in the case of the second aspect. The minimum level for the first aspect of the invention may even be higher, such as 35% or 40% by weight. In the case of the second aspect, optionally it could be 25%, 30%, 35% or 45% by weight. Preferred maximum levels of the auxiliary are 60%, 70%, 80%, 90%, 95% or 99% by weight.

Functional Cleaning Materials

As component (b), essential functional cleaning materials for the second aspect of the present invention and preferred for the first aspect of the present invention are those which are temperature sensitive.

Preferably, a functional cleaning material is "functional" if it conveys any beneficial effect in a wash liquor, be it detergency, bleaching, other soil removal, imparting of a pleasant odour, reducing or enhancing foam levels, inhibiting machine corrosion, promoting fabric care, inhibiting dye damage or transfer of the like. Suitable fabric care promoting ingredients include those for reducing the effects of abrasion in the wash, rebuilding fabric, retaining body or shape, anti-wrinkling ingredients, those promoting ease of ironing and fabric softening materials. Excluded from functional materials included in category (b) of either aspect of the invention are enzymes and inorganic compounds.

Preferably, a temperature sensitive functional cleaning material is to be regarded as one which physically and/or chemically degrades by more than 20% if stored alone on an exposed inert surface (not in a container) at 50° C. for 30 days at 1 atmosphere at 70% relative humidity.

Preferred temperature sensitive cleaning material may be selected from one or more of surfactants, organic detergency builders, organic bleaches and organic bleach activators, organic or organometallic bleach catalysts, soil release polymers, fluorescers, anti-dye transfer agents, antifoams and perfumes.

Perfume Microcapsules

The granules according to the first or the second aspect of the present invention preferably comprise perfume, especially in the form of perfume microcapsules, and most especially at levels more than 1%, preferably more than 3%, more preferably from 10% to 60% by weight of the perfume microcapsules. Preferably, these are of the kind which comprise a core of carrier material impregnated with a perfume, the impregnated core being coated with a friable coating. Perfumes in general and perfume microcapsules in particular can be considered as functional cleaning materials, especially temperature sensitive functional cleaning materials.

One preferred class of microcapsule comprises those generally of the kind described in U.S. Pat. No. 5,066,419. As mentioned above, these comprise a core having from about 5% to about 50% by weight of perfume dispersed in from about 95% to about 50% by weight of a carrier material. This carrier material is a non-polymeric solid fatty alcohol or fatty ester carrier material, or mixtures thereof. The esters or alcohols have a molecular weight of from about 100 to about 500 and a melting point from about 37° C. to about 80° C. The alcohols or esters are substantially water-insoluble. The core comprising the perfume and the carrier material are coated in a substantially water-insoluble coating on their outer surfaces. Although the microcapsules recited in U.S. Pat. No. 5,066,419 are indicated as having an average particle size less than about 350 microns, preferably less than 150 microns, for the avoidance of doubt, in the context of the present invention, these particles preferably have a $d_{4,3}$ average particle size of from 0.01μ to 300μ more preferably from 1μ to 100μ. Similar microcapsules are disclosed in U.S. Pat. No. 5,154,842 and these are also suitable.

The microcapsules as described in U.S. Pat. No. 5,066,419 have a friable coating which is preferably an aminoplast polymer. Most preferably, this is the reaction product of an amine selected from urea and melamine, or mixtures thereof, and the aldehyde selected from formaldehyde, acetaldehyde, glutaraldehyde or mixtures thereof. Preferably, the coating is from 1 to 30% by weight of the particles. The carrier material preferably comprises an alcohol selected from the $C_{14}$-$C_{18}$ alcohols or an ester comprising at least 18 carbon atoms.

However, perfume microcapsules of other kinds are also suitable for use in all aspects of the present invention. Ways of making such other microencapsulates of perfume include precipitation and deposition of polymers at the interface such as in coacervates, as disclosed in GB-A-751 600, U.S. Pat. No. 3,341,466 and EP-A-385 534, as well as other polymerisation routes such as interfacial condensation, as described in U.S. Pat. No. 3,577,515, US-A-2003/0125222, U.S. Pat. No. 6,020,066 and WO-A-03/101606.

Bleaches

Granulates according to the first or second aspect of the present invention may contain a bleach for example at levels from 0% to 10%, preferably from 0% to 2% by weight from 0% to 1%, preferably from 0% to 0.1% by weight of a bleach based on the weight of the persalt without any water of hydration. However, substantial total exclusion of bleach is especially preferred.

Organic bleaches may fall under the definition of temperature sensitive functional cleaning materials. Inorganic bleaches fall under category (c) namely optional other ingredients, as they are excluded, as inorganic compounds, from category (b).

Suitable inorganic bleaches are persalt bleaches are the alkali metal perborates, percarbonates, perphosphates, persilicates and persulphates. Preferred inorganic persalts are sodium perborate monohydrate and tetrahydrate, and sodium percarbonate.

Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound may be used in conjunction with a bleach activator (bleach precursor) to improve bleaching action at low wash temperatures.

Preferred bleach precursors are peroxycarboxylic acid precursors, more especially peracetic acid precursors and pernonanoic acid precursors. Especially preferred bleach precursors suitable for use in the present invention are N,N,N',N',-tetracetyl ethylenediamine (TAED) and sodium nonanoyloxybenzene sulphonate (SNOBS). The quaternary ammonium and phosphonium bleach precursors disclosed in U.S. Pat. No. 4,751,015 and U.S. Pat. No. 4,818,426 and EP-A-402 971, and the cationic bleach precursors disclosed in EP-A-284 292 and EP-A-303 520 (Kao) are also of interest.

The bleach system can be either supplemented with or replaced by a peroxyacid. Examples of such peracids can be found in U.S. Pat. No. 4,686,063 and U.S. Pat. No. 5,397,501. A preferred example is the imido peroxycarboxylic class of peracids described in EP-A-325 288, EP-A-349 940, DE-A-382 3172 and EP-A-325 289. A particularly preferred example is phthalimido peroxy caproic acid (PAP). Such peracids are suitably present at 0.1-12%, preferably 0.5-10%.

A bleach stabiliser (transition metal sequestrant) may also be present. Suitable bleach stabilisers include ethylenediamine tetra-acetate (EDTA), the polyphosphonates such as Dequest (Trade Mark) and non-phosphate stabilisers such as EDDS (ethylene diamine di-succinic acid). These bleach stabilisers are also useful for stain removal especially in products containing low levels of bleaching species or no bleaching species.

Bleach catalysts, alone or with other bleach components may also be present. An especially preferred bleach system comprises a peroxy bleach compound (preferably sodium percarbonate optionally together with a bleach activator), and a transition metal bleach catalyst as described and claimed in EP-A-458 397, EP-A-458 398 and EP-A-509 787A. Bleach catalysts which are uncomplexed ligands may be regarded as functional cleaning materials, especially temperature sensitive functional cleaning materials.

Surfactant

Granulates according to the first or second present invention may optionally contain surfactant, for example, higher levels up to 70% or up to 50% by weight or lower levels such as up to 15% or up to 10% by weight of surfactant. Substantially total exclusion of surfactant is desirable.

The surfactants may comprise one or more surfactant materials selected from synthetic detergent (surfactant) agents and soaps.

In general, suitable surfactants include those generally described in "Surface active agents and detergents" Vol. I by Schwartz and Perry. If desired, soap derived from saturated or unsaturated fatty acids having, for example, $C_{10}$ to $C_{18}$ carbon atoms may also be present.

Anionic surfactant may actually comprise one or more different anionic surfactant compounds. Preferred anionic surfactants are alkylbenzene sulphonates, particularly so-called linear alkylbenzene sulphonates having an alkyl chain length of $C_8$-$C_{15}$ Additionally or alternatively, other anionic surfactants may be used. Other suitable anionic surfactants are well-known to those skilled in the art. Examples include primary and secondary alkyl sulphates, particularly $C_8$-$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

The surfactant may also comprise nonionic surfactant. Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Detergency Builders

Granulates according to the first or second aspect of the present invention preferably comprise one or more detergency builders. These may be organic or inorganic. The latter, as inorganic compounds, are optional category (c) ingredients and cannot form all or part of category (b) ingredients.

Preferred inorganic detergency builders are selected from one or more alumino silicates, preferably alkali metal, especially sodium alumino silicate.

The alkali metal alumino silicate may be either crystalline or amorphous or mixtures thereof, having the general formula: 0.8-1.5 $Na_2O$. $Al_2O_3$. 0.8-6 $SiO_2$ These materials contain some bound water and are required to have a calcium ion exchange capacity of at least 50 mg CaO/g. The preferred sodium alumino silicates contain 1.5-3.5 $SiO_2$ units (in the formula above). Both the amorphous and the crystalline materials can be prepared readily by reaction between sodium silicate and sodium aluminate, as amply described in the literature. Suitable crystalline sodium alumino silicate ion-exchange detergency builders are described, for example, in GB 1 429 143 (Procter & Gamble). The preferred sodium aluminosilicates of this type are the well-known commercially available zeolites A and X, and mixtures thereof.

The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP 384 070A (Unilever). Zeolite MAP is defined as an alkali metal alumino silicate of the zeolite P type having a silicon to aluminium ratio not exceeding 1.33, preferably within the range of from 0.90 to 1.33, and more preferably within the range of from 0.90 to 1.20.

Especially preferred is zeolite MAP having a silicon to aluminium ratio not exceeding 1.07, more preferably about 1.00. The calcium binding capacity of zeolite MAP is generally at least 150 mg CaO per g of anhydrous material.

Other suitable inorganic builders include alkali metal (especially sodium) carbonates, bicarbonates, sesquicarbonates and Burkite, any of which may be used in combination with a seed crystal material such as calcite.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di and trisuccinates, carboxymethyloxy succinates, carboxymethyloxymalonates, dipicolinates, hydroxyethyl imino diacetates, alkyl-and alkenyl malonates and succinates; and sulphonated fatty acid salts. This list is not intended to be exhaustive.

Enzymes

The granulates according to the invention may also contain one or more enzyme(s). Suitable enzymes include the proteases, amylases, cellulases, oxidases, peroxidases and lipases usable for incorporation in detergent compositions. Preferred proteolytic enzymes (proteases) are, catalytically active protein materials which degrade or alter protein types of stains when present as in fabric stains in a hydrolysis reaction. They may be of any suitable origin, such as vegetable, animal, bacterial or yeast origin.

Optional Polymer Material

Preferably, but not essentially, granulates according to the first or second aspects of the present invention may comprise a polymer material capable of one or more functions selected from granule binder, agglomerating aid and deposition aid.

Preferably, such a polymer is selected from synthetic polymers and natural or modified natural polymers with molecular weights of less than 300,000 KDa, more preferably less than 100,000 KDa, still more preferably from 50 KDa to 350 KDa.

Examples of synthetic water soluble polymers of this kind are:

(1) polyvinyl pyrrolidone;
(2) water soluble celluloses;
(3) polyvinyl alcohol;
(4) ethylene maleic anhydride copolymer
(5) methyl vinyl ether maleic anhydride copolymer;
(6) polyethylene oxides;
(7) water soluble polyamide or polyester;
(8) copolymers or homopolymers of acrylic acid such as polyacrylic acid, polystyrene acrylic acid copolymers or mixtures of two or more;

Examples of water soluble hydroxyalkyl and carboxyalkyl celluloses include hydroxyethyl and carboxymethyl cellulose, hydroxyethyl and carboxymethyl cellulose, hydroxymethyl and carboxymethyl cellulose, hydroxypropyl carboxymethyl cellulose, hydroxypropyl methyl carboxyethyl cellulose, hydroxylpropyl carboxypropyl cellulose, hydroxybutyl carboxymethyl cellulose, and the like. Also useful are alkali metal salts of these carboxyalkyl celluloses, particularly and preferably the sodium and potassium derivatives.

Examples of water soluble natural and modified natural polymers are starch, gums and gelatine. Modified starch in its myriad of forms, including dextrins, is useful within the invention, as well as hydrolyzed gums and hydrolyzed gelatine. Various modified starches are described in U.S. Pat. No. 2,876,160.

Suitable hydrolyzed gums include gum Arabic, larch, pectin, tragacanth, locust bean, guar, alginates, carrageenans, cellulose gums such as carboxy methyl cellulose and karaya.

Appropriate modified starches have a dextrose equivalent of 0.25 up to about 20, preferably 5 to 15.

A wide range of starch hydrolysates having dextrose equivalents of up to 95 are also useful. Until recently these starch hydrolysates, also called maltodextrins and dextrins were produced from various starches by acid hydrolysis. The hydrolysates resulting from this acid process are not completely soluble in water, and contain native starch. Suitable starches are derived from corn, waxy maize, tapioca, etc.

Preferably, the granules contain up to 30%, preferably from 1% to 20% by weight of such polymer material.

Optional Solid Water Insoluble Inert Carrier Material

Preferably, compositions according to the first or second aspects of the present invention also contain a water-insoluble solid inert carrier material. Preferably, this is selected from alumina, magnesium silicate, calcium silicate, magnesium hydroxide, barium sulphate, silica, aluminosilicates such as zeolites, and minerals such as clay or calcium carbonate, calcite and mixtures thereof. It will be appreciated that some of these materials are also functional in the sense that they are water-insoluble detergency builders.

Preferably, the amount of the water-insoluble inert carrier material in the granules is up to 70%, preferably from 10% to 50% by weight of those granules.

Other Optional Ingredients

Granulates according to the first or second aspects of the present invention optionally contain component (c), namely one or more other ingredients than components (a) and (b). The total amount of these other materials is preferably no more than 50%, more preferably no more than 40%, still more preferably no more than 20%, especially no more than 10%, by weight of the granulate.

Compositional Applications

Any granulate according to the first or third aspect of the present invention may be incorporated in a detergent composition comprising one or more post dosed materials, granular and/or powdered. Optionally, any detergent composition according to any aspect of the present invention may be compressed into tablet form by known technique, e.g. such a tablet also comprising a disintegrant. Such a tablet constitutes a further aspect of the invention. Optionally, and also constituting an aspect of the invention, is the inclusion of such a granular and/or powdered composition in a water soluble or dispersible sachet or pouch.

Any such composition contains at least one ingredient selected from surfactant and softening material, optionally also detergency builder and optionally also, one or more other ingredients commonly found in detergent compositions. Typical such ingredients are any of recited hereinbefore as essential ingredients of granulates according to the first or third aspects of the present invention.

In such a composition for laundry use, it is preferred that if present the level of any linear alkylbenzene sulphonate surfactant is from 0 wt % to 30 wt %, more preferably 1 wt % to 25 wt %, most preferably from 2 wt % to 15 wt %.

It is also preferred that if present, the level of any nonionic surfactant is from 0 wt % to 30 wt %, more preferably from 1 wt % to 25 wt %, most preferably from 2 wt % to 15 wt %.

Detergency builders may generally be incorporated in amounts of from 10 to 70% by weight (anhydrous basis), preferably from 25 to 50 wt %. Preferred detergency builders are alkali metal, preferably sodium, aluminosilicate builder.

Especially preferred organic builders are the citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Any peroxy bleach compound is suitably present in an amount of from 0.1 to 35 wt %, preferably from 0.5 to 25 wt. Any bleach precursor is suitably present in an amount of from 0.1 to 8 wt %, preferably from 0.5 to 5 wt %.

Detergency enzymes are commonly employed in granular form in amounts of from about 0.1 to about 3.0 wt %. However, any suitable physical form of enzyme may be used.

The term softening material is used herein for purposes of convenience to refer to materials which provide softening and/or conditioning benefits to fabrics in the wash cycle of a home or automatic laundering machine or in a manual wash process.

When the detergent composition according the invention comprise softening material, the compositions preferably comprise from 10 to 95% by weight of softening material (active ingredient), based on the total weight of the composition, more preferably 15 to 75% by weight, most preferably 20 to 50% by weight, e.g. 22 to 45% by weight.

The softening material comprises preferably at least one cationic softening material such as quaternary ammonium fabric softening material. Preferably the quaternary ammonium fabric softening material has two C12-28 alkyl or alkenyl groups connected to the nitrogen head group, preferably via at least one ester link. It is more preferred if the quaternary ammonium material has two ester links present.

Preferably, the average chain length of the alkyl or alkenyl group is at least C14, more preferably at least C16. Most preferably at least half of the chains have a length of C18.

It is generally preferred that the alkyl or alkenyl chains are predominantly linear.

Especially preferred materials are di-alkenyl esters of triethanol ammonium methyl sulphate and N-N-di(tallowoyloxy ethyl) N,N-dimethyl ammonium chloride. Commercial examples include Tetranyl AHT-1 (di-hardened oleic ester of triethanol ammonium methyl sulphate 80% active), AT-1 (di-oleic ester of triethanol ammonium methyl sulphate 90% active), L5/90 (palm ester of triethanol ammonium methyl sulphate 90% active), all ex Kao™. Other unsaturated quaternary ammonium materials include Rewoquat™ WE15 (C10-C20 and C16-C18 unsaturated fatty acid reaction products with triethanolamine dimethyl sulphate quaternised 90% active), ex Witco™ Corporation.

Other preferred materials include 1,2 bis[tallowoyloxy]-3-trimethylammonium propane chloride and 1,2-bis[oleyloxy]-3-trimethylammonium propane chloride, the method of preparation thereof are, for example, described in U.S. Pat. No. 4,137,180 (Lever Brothers) of which the contents are incorporated herein. Preferably these materials also comprise small amounts of the corresponding monoester, as described in U.S. Pat. No. 4,137,180.

When the detergent composition is to be used as a solid rinse conditioner, the granulate may be used in a composition as described in WO03/083027. Other examples of suitable solid rinse conditioners are described in EP-A-0 234 082, EP-A-0 111 074, EP-A-0 111 074, WO 92/18593, EP-B1-0 568 297, U.S. Pat. No. 5,259,964, EP-A-0 107 479 (Unilever), EP-A-0 267 999 (Unilever), JP-A-06 306 769, JP-A-62 057 639 (Lion), JP-A-02 182 972, U.S. Pat. No. 4,814,095, GB-A-2 348 435.

Another class of softening materials are fabric softening clays. In particular those that co-operate with the organic fatty softener materials to provide enhanced softening of laundry. Such clays include the montmorillonite-containing clays which have swelling properties (in water) and which are of smectite structure. The best of the smectite clays for use in the present invention is bentonite and the best of the bentonites are those which have a substantial swelling capability in water, such as the sodium and potassium bentonites. Other bentonites, such as calcium bentonite, are normally non-swelling and usually are, in themselves, unacceptable as fabric softening agents.

However, it has been found that such non-swelling bentonites exhibit even better fabric softening in combination with organic fatty softener materials than do the swelling bentonites, provided that there is present in the softening composition, a source of alkali metal or other solubilising ion, such as sodium (which may come from sodium hydroxide, added to the composition, or from sodium salts, such as builders and fillers, which may be functional components of the composition). Among the preferred bentonites are those of sodium and potassium, which are normally swelling, and calcium and magnesium, which are normally non-swelling. Of these it is preferred to utilise calcium (with a source of sodium being present) and sodium bentonites. Also, other montmorillonite-containing smectite clays of properties like those of the bentonites described may be substituted in whole or in part for the bentonites described herein and similar fabric softening results will be obtained.

A detailed description of the process for treating bentonite in accordance with the present invention is disclosed in WO 00/03959 filed in the name of Colin Stewart Minchem, Ltd., the disclosure of which is incorporated herein by reference.

A main component which may be used in combination with the fabric softening clay is an organic fatty softener. The organic softener can be anionic, cationic or nonionic fatty chains (C10-C22 preferably C12-C18) Anionic softeners include fatty acids soaps. Preferred organic softeners are nonionics such as fatty esters, ethoxylated fatty esters, fatty alcohols and polyols polymers. The organic softener is most preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers.

Pentaerythritol compound, abbreviated as PEC herein, which description and abbreviation may apply to any or all of pentaerythritol, oligomers, thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two, e.g., 1 or 2 to 4, are esterified by a higher fatty acid or other higher aliphatic acid, which can be of an odd number of carbon atoms.

The higher fatty acid esters of the pentaerythritol compounds are preferably partial esters. And more preferably there will be at least two free hydroxyls thereon after esterification (on the pentaerythritol, oligomer or alkoxyalkane groups). Frequently, the number of such free hydroxyls is two or about two but sometimes it may by one, as in pentaerythritol tristearate. The higher aliphatic or fatty acids that may be employed as esterifying acids are those of carbon atom contents in the range of 8 to 24, preferably 12 to 22 and more preferably 12 to 18, e.g., lauric, myristic, paimitic, oleic, stearic and behenic acids. Such may be mixtures of such fatty acids, obtained from natural sources, such as tallow or coconut oil, or from such natural air materials that have been hydrogenated. Synthetic acids of odd or even numbers of carbon atoms may also be employed. Of the fatty acids lauric and stearic acids are often preferred, and such preference may depend on the pentaerythritol compound being esterified.

Examples of suitable detergent compositions containing clay include those described in U.S. Pat. No. 6,291,421 and U.S. Pat. No. 6,670,320.

The Process

According to the second and fourth aspects of the present invention, granulates according to the present invention can be manufactured by means of a mechanical mixing granulation process. Such processes are well known in the art. They include the so-called fluid (e.g. fluidized bed) granulation techniques. These mechanical mixing granulation processes do not involve spray drying to form the granule but one or more of the starting materials may optionally be spray-dried granules.

In the apparatus of choice, if the functional cleaning material comprises perfume microcapsules, these can be applied in the form of a suspension (slurry). Typically, this comprises from 10% to 80% by weight of the perfume microcapsules and from 20% to 90% by weight of water. Optionally, other ingredients may be included in the slurry, for example from 0% to 40% by weight of a polymeric material to impart deposition or other beneficial properties. Suitable such polymeric materials are any one or more of those previously recited as examples of "optional polymer materials".

When surfactant is included in the form of anionic surfactant, this can be added in the form of the salt (typically sodium salt) of the organic anion, or it may be made in situ by admixture of the liquid precursor of an anionic surfactant and a neutralising agent such as sodium carbonate, although this is generally less preferred.

Brief details of suitable granulating apparatus will now be given.

A process according to the third aspect of the present invention may be carried out in either batch or continuous mode of operation as desired.

The process of the invention is preferably carried out in a mechanical granulator, most preferably a low-or moderate shear machine. A low-or moderate-shear mixer/granulator often has a stirring action and/or a cutting action which are operated independently of one another. Preferred types of low-or moderate-shear mixer granulators are mixers of the Loedige KM series, Gericke GCM series (respectively from Loedige Germany and Gericke Powder Processing Equipment and Systems, Switzerland) Fukae® FS-G series; Diosna® V series ex Dierks & Sohne, Germany; Pharma Matrix® ex. T.K. Fielder Ltd, England. Other mixers which are suitable for use in the process of the invention are Fuji® VG-C series ex Fuji Sangyo Co., Japan; the Roto® ex Zanchetta & Co. srl, Italy, Schugi® Flexomix granulator, ex Hosokawa Netherlands and Eirich Intensivmischer, Eirich Germany.

Another possible low shear granulator is one of the gas fluidisation type, which comprises a fluidisation zone in which the liquid binder is sprayed into or onto the solid neutralising agent. However, a low shear bowl mixer/granulator can also be used. When the low shear granulator is of the gas fluidisation kind it may sometimes be preferable to use equipment of the kind provided with a vibrating bed. This may be preferable if the perfume loading of the slurry is to be low and when drying is required. Gentle heating of the fluidisation air is preferred to avoid premature perfume release.

If the low-shear granulator is of the gas fluidisation kind, then the liquid binder can be sprayed from above and/or below and/or within the midst of the fluidised material.

If a gas fluidisation granulator is used as the low-shear granulator, then preferably it is operated at a superficial air velocity of about 0.1-2.0 $ms^{-1}$, either under positive or negative relative pressure and with an air inlet temperature ranging from −10° or 5° C. up to 80° C., or in some cases, up to 200° C. An operational temperature inside the bed of from ambient temperature to 60° C. is typical. Depending on the process, it may be advantageous to vary the temperature (upwardly and/or downwards, during at least part of the process).

It is also possible to granulate the ingredients first in a high shear mixer such as a Loedige C series recycler and then in a moderate or low shear mixer, especially of fluid bed type with optional drying and cooling. Any temperature sensitive ingredient(s) can be added in either mixer or in both but preferably, at least 50% by weight of each or of all of such ingredients is/are added in the low or moderate shear mixer.

Granule Size and Density

Granulates according to the present invention may preferably have a $d_{4,3}$ average particle diameter of from 100 microns to 2,000 microns, preferably from 500 microns to 700 microns.

Granulates according to the present invention preferably have a relating narrow particle size distribution, for example having no more than 10%, preferably no more than 5% by weight of particles below 250 microns diameter and no more than 10%, preferably no more than 5% by weight of particles above 1,400 microns diameter.

Granulates according to the first and third aspects of the invention, especially those made by methods according to the second and fourth aspects of the present invention, preferably have a bulk density of at least 550 g/l, more preferably at least 600 g/l, eg at least 700 g/l and preferably no more than 1800 g/l, more preferably no more than 1200 g/l and for example, no more than 900 g/l.

The present invention will now be explained in more detail by way of the following non-limiting examples.

EXAMPLE 1

33 g of sugar and 67 g of zeolite was blended together in a Moulinette for 2 minutes. Thereafter 30 g of melamine-capsule slurry was added in batches of 5 g with thorough mixing in the Moulinette for about 60 seconds after every addition. The agglomerated mass was then transferred to a Retsch fluidized bed and dried using ambient air for 10 minutes. The resulting powder was sieved between 180 and 1400 microns to give a free flowing powder with excellent solubility but low friability and which has no segregation risk when added to a standard detergent powder.

The invention claimed is:

1. A particulate cleaning product, comprising:

(a) at least 20% by weight of granulation auxiliary selected from water-soluble crystalline saccharide solids;

(b) at least 0.1% by weight of a core/shell encapsulated perfume; and (c) optionally, one or more other ingredients, wherein (a), (b) and (c) are present in separate individual particles, and wherein said water-soluble crystalline saccharide solid does not coat said core/shell encapsulated perfume.

2. A particulate cleaning product according to claim 1, wherein said optional one or more other ingredients are one or more surfactants, organic detergency builders, organic bleaches, organic bleach activators, organic and organometallic bleach catalysts, soil release polymers, fluorescers, fabric care agents, anti-dye transfer agents, antifoams, perfumes, enzymes or inorganic compounds.

3. A particulate cleaning product according to claim 1, wherein the granulation auxiliary is selected from the group consisting of: isomaltose, isomaltotriose, isomaltotetraose, isomalto oligosaccharide, fructo oligosaccharide, levo oligosaccharide, galacto oligosaccharide, xylo oligosaccharide, gentio oligosaccharide, disaccharides, glucose, dextrose, levose, fructose, galactose, xylose, mannose, sorbose, arabinose, rhamnose, fucose, maltose, sucrose, lactose, maltulose, ribose, lyxose, allose, altrose, gulose, idose, talose, trehalose, nigerose, kojibiose, lactulose, oligosaccharides, malto oligosaccharides, trisaccharides, tetrasaccharides, pentasaccharides, hexasaccharides, oligosaccharides from partial hydrolysates of natural polysaccharide sources and mixtures thereof.

4. A particulate cleaning product according to claim 1, comprising from 30% to 95% by weight of the granulation auxiliary.

5. A process of manufacturing a particulate cleaning product according to claim 1, the process comprising granulating in a mechanical granulator, components (a), (b) and (c) to form said granules.

6. A detergent composition comprising a particulate cleaning product according to claim 1, from 0% to 30% by weight of a linear alkylbenzene sulphonate surfactant and from 10% to 70% by weight of a detergency builder.

7. A detergent composition comprising a particulate cleaning product according to claim 1 and from 10% to 95% by weight of softening material.

8. A particulate cleaning product according to claim 1, comprising from 20% to 95% by weight of the granulation auxiliary.

9. A particulate cleaning product according to claim 1, comprising from 30% to 70% by weight of the granulation auxiliary.

* * * * *